US005686681A

United States Patent [19]

Powell

[11] Patent Number: 5,686,681

[45] Date of Patent: Nov. 11, 1997

[54] STRING CLAMPING PLATE EXTRACTOR FOR FLOYD ROSE TREMOLO

[76] Inventor: Steven Donald Powell, 366 Riviera Dr., Union City, Calif. 94587

[21] Appl. No.: 972,750

[22] Filed: Nov. 9, 1992

[51] Int. Cl.[6] ..... G10G 7/00

[52] U.S. Cl. ..... 84/458; 84/313; 254/24

[58] Field of Search ..... 84/453, 313, 458; 254/18, 23, 24, 106, 124

[56] References Cited

U.S. PATENT DOCUMENTS

| | | | |
|---|---|---|---|
| 810,285 | 1/1906 | King | 84/458 |
| 4,171,661 | 10/1979 | Rose | 84/313 |
| 4,497,236 | 2/1985 | Rose | 84/313 |
| 4,688,461 | 8/1987 | Stroh | 84/313 |
| 4,708,182 | 11/1987 | Laker | 84/453 |
| 4,967,631 | 11/1990 | Rose | 84/313 |

*Primary Examiner*—Cassandra C. Spyrou
*Attorney, Agent, or Firm*—James J. Leary

[57] ABSTRACT

An extractor (30) for removing string clamping plates (26) from Floyd Rose tremolos (20) has a tongue (36) with a pin (38) which can engage hole (27) in plate (26) so that threaded element (42) when rotated will engage saddle surface (23) and apply upward force on tongue (36) and pin (38) and thus pull plate (26) into cylindrical extension (46) during removal of the string clamping plate.

13 Claims, 3 Drawing Sheets

60
34
32
30
40
44
42

46
36
38
61
64
63
62
26
27

42
46
36
38
68
65
67
66
34
30
32

40
44
46
42
48
36
24
23
26
38
22
28
27
25
35
29

STRING CLAMPING PLATE EXTRACTOR FOR FLOYD ROSE TREMOLO

BACKGROUND

1. Field of Invention

The present invention relates to musical instruments, in particular to a tool for repairing guitars fitted with Floyd Rose tremolos.

2. Description of Prior-Art

From time to time in any stringed musical instrument, a string will break, making it necessary to replace it before playing can continue. For most guitars this is not a difficult problem, as the strings have a loop or ball at one end by which it can be anchored to a hook, a slot, or the hole-and-peg on a fixed bridge on a guitar. However, many guitars do not have a fixed bridge; instead, they are fitted with a Floyd Rose tremolo, which lacks the regular string anchoring means found on fixed bridges.

"A tremolo is a "floating" bridge, which is pivotably fitted to a guitar and replaces the fixed bridge. It has an extended lever by which a player can use to physically rock the tremolo and thus manipulate the tension of the strings while playing the guitar. In doing so, a player can achieve a vibrato effect in the sound of the guitar.

The Floyd Rose tremolo, considered by many to be the best tremolo on the market, is described in U.S. Pat. No. 4,171,661 and No. 4,497,236, the specifications of which are hereby incorporated by reference."

Strings for guitars which are fitted with the Floyd Rose tremolo have no loop or ball. Instead, the end of the string is anchored by jamming it between two flat surfaces provided on the tremolos. Force is obtained by a clamp screw which, when turned, exerts force against one side of a single string-clamping plate, forcing it to jam the string's end against a flat side in the central opening slot of the saddle of the tremolo. This effectively anchors the string to the saddle.

High pitched strings are plain piano wire. Larger, low-pitched strings are piano wire wound with nickel, bronze, or steel wire. More expensive strings are wound with gold plated wire. Strings for Floyd Rose tremolos are sweated at the end to make them hold more effectively in the clamping mechanism of the Floyd Rose tremolo.

When tuned, a six or seven string guitar exerts a total tension of 100 pounds (50 kg.) or more on the strings. Therefore, considerable pressure is required to securely clamp the end of the string to prevent it slipping out from between the saddle and the string clamping plate.

When fitting a new string, the end is first inserted to the bottom of the relatively deep central opening slot in the saddle of the Floyd Rose tremolo. It should be directed into the slot so that it's side is at an angle of 90 degrees to the transitional top face of the saddle. It is then locked in position by inserting the string clamping plate into the central opening slot, then forcing it against the string with the clamp screw. This plate fits very neatly, with minimal side clearance, at a level below the face of the central opening slot, and under extreme pressure from the clamp screw.

Sometimes, however, a plate will have to be removed for inspection, cleaning, or replacement. If foreign matter has accumulated and coagulated between the plate and the opening sides, the plate may become sealed. Alternatively, the plate may split in half due to pressure from the clamp screw, causing the halves to spread apart and jam when attempts are made to remove it. Under such circumstances, removing the plate can become a serious problem.

The use of the tremolo causes wear on the strings at a point where the string makes contact with the upper part of the saddle. Overtightening the clamp screw causes damage to the string's end, the clamp plate and the saddle. Frequent maintenance is required to keep these parts in order.

Various probes, such as pen knives, screw drivers, blades needles, pins, needle-nosed pliers, hemostat clamps, etc. have been used in attempts to remove jammed plates. Such instruments frequently damage the opening sides as well as the plate itself, to such an extent that the entire saddle and plate must be replaced. These parts are expensive. Also, when a front plate is jammed so that it cannot be easily removed from above, many professionals remove the saddle from the tremolo and drive the plate out through the bottom of the saddle with a punch and hammer. Unfortunately, this action also removes a brass seat from the bottom of the saddle.

The purpose of this brass seat is to position the clamping plate so as to properly align the clamping plate with the spigot on the end of the clamping screw, when replacing the clamping plate. Once removed, this brass seat cannot be replaced. Whereas expert repairmen can replace the clamping plate even in the absence of the brass seat, this task is practically impossible for the inexperienced. Therefore, most musicians will have to pay an expert to fit the clamping plate and new strings.

Guitar strings which have a ball or a loop at one end can be used on guitars which are fitted with a Floyd Rose tremolo by reversing the string "end-to-end." This is done by first threading the string through the eye of the winding head at the nut end, as far as it will go, then inserting the other end into the opening of the saddle and locking it with the clamping plate and the clamp screw.

Objects and Advantages

Accordingly, several objects and advantages of the present invention are: 1) to provide a device for attaching to a string clamping plate; 2) to provide a device to urge the plate upwards; 3) to provide an opportunity for the user to directly assess the plates resistance to being moved; 4) to provide a device to exert substantial upward force; 5) to provide a device for moving the plate about in the slot, thereby loosening the grip if it is jammed; 6) to provide a device to remove the plate without damaging the central opening slot; 7) to provide a device for removing a jammed plate without having to drive it out through the bottom of the saddle; 8) to provide a device to quickly remove a plate that is not jammed; 9) to provide a maintenance device for guitars fitted with Floyd Rose tremolos.

DETAILED DESCRIPTION OF THE PREFERRED EMBODIMENT

Figure 1:
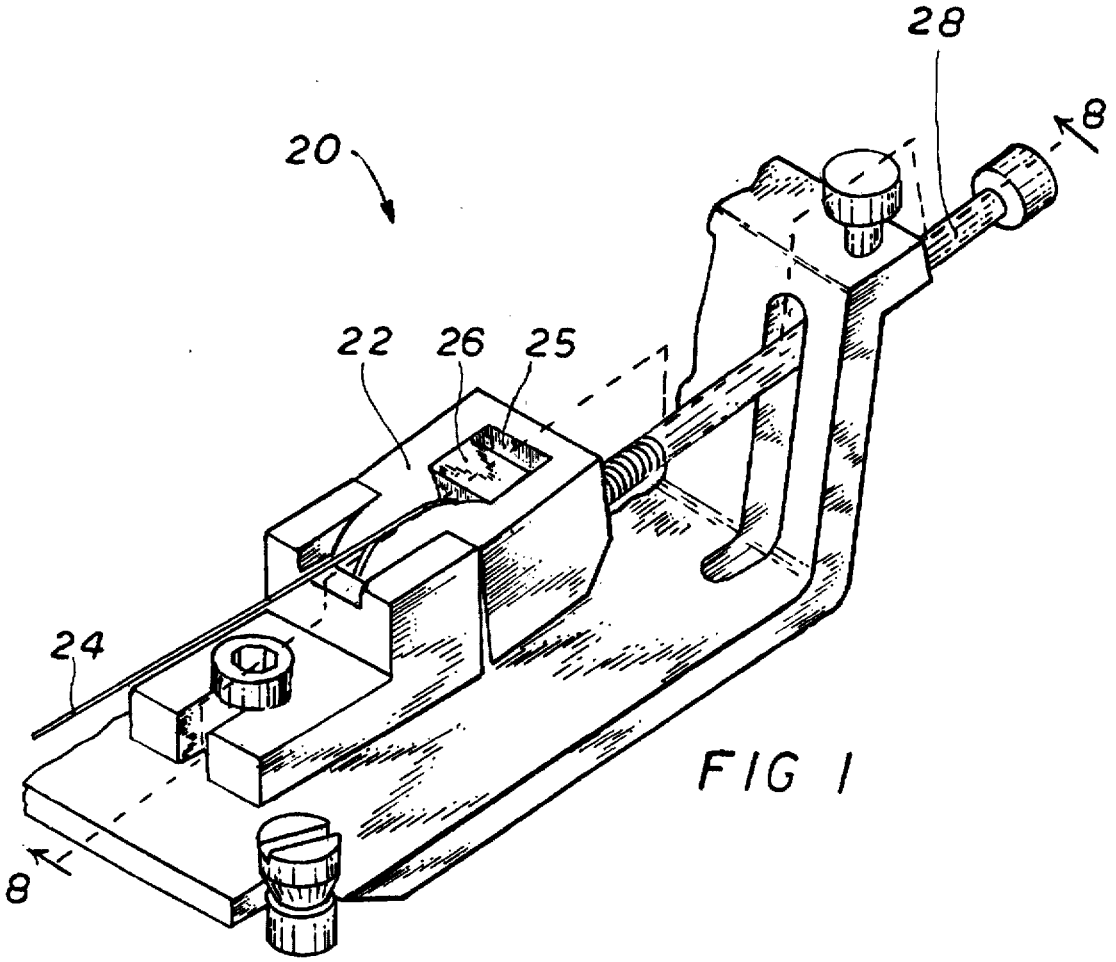
FIG. 1 is a perspective view of a portion of a Floyd Rose tremolo, showing a saddle, string, string clamping plate, central opening slot, and the clamping screw.

FIG. 1 shows a perspective view of a portion of a Floyd Rose tremolo 20, a single string saddle 22, string 24, a single string clamping plate 26, central opening slot 25, and clamping screw 28. Clamping screw 28 has a spigot 29 (FIGS. 5 and 8), which is sized to fit hole 27 of clamping plate during normal use. The purpose of spigot 29 is to locate plate 26 in correct position while clamping a string.

Figures 2, 3, 4, 5:
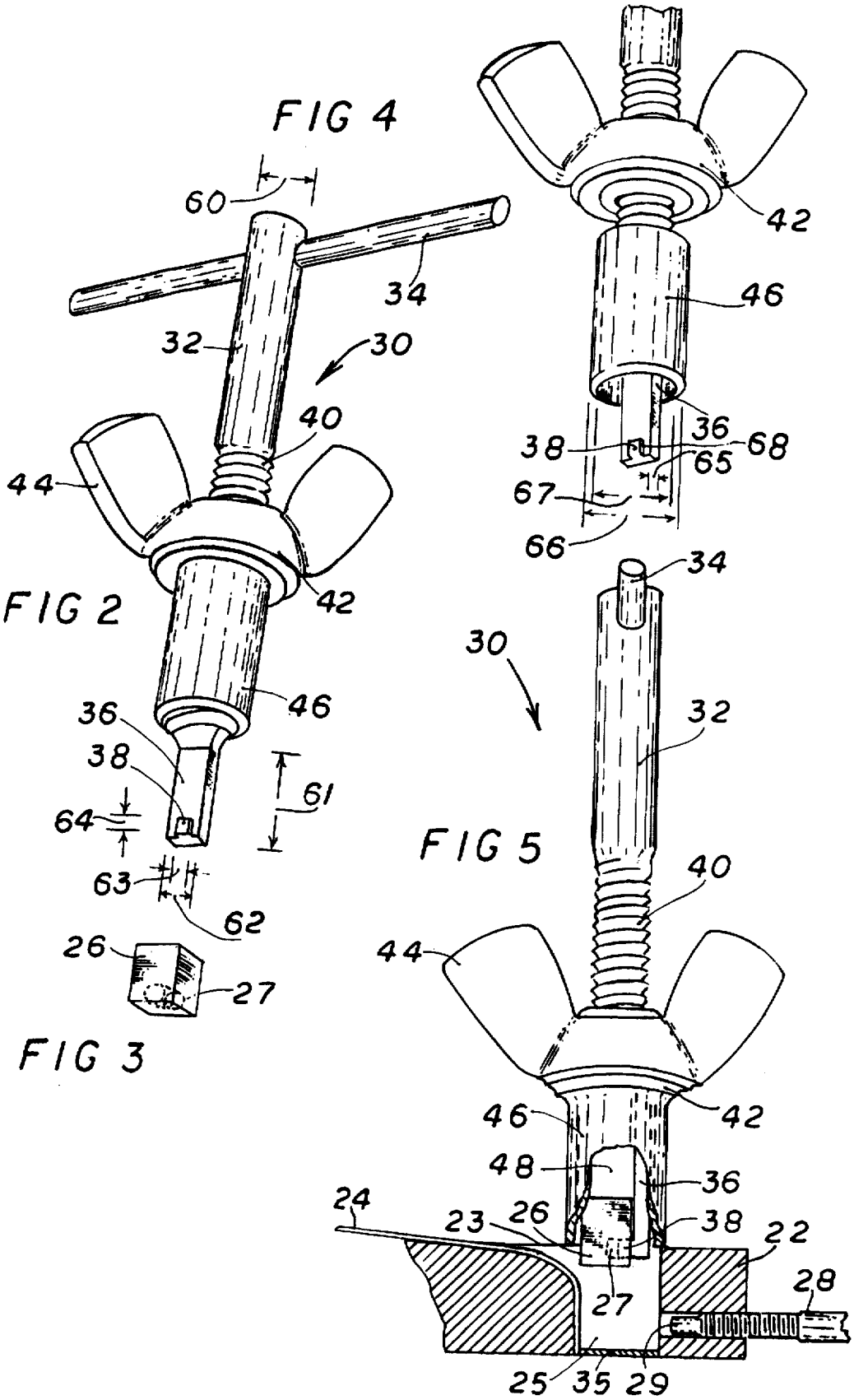
FIG. 2 is a perspective view of the extractor showing the preferred embodiment of the invention with an integral cylindrical extension.
FIG. 3 is a perspective view of a string clamping plate.
FIG. 4 is a perspective view of part of the extractor of FIG. 2 with a separate cylindrical extension.
FIG. 5 is a part sectioned, part perspective view showing the extractor shown in FIG. 2 removing a clamping plate.

FIG. 2 shows extractor 30, having a handle stem 32, a handle 34 at its first end, a tongue 36 and an integrally machined pin 38 at its second end. A threaded section 40, is mated with a threaded element 42 which includes a wingnut 44 at its upper end and a cylindrical extension 46 at its lower end. When wingnut 44 is rotated in relation to handle stem 32, extension 46 will move axially in relation to tongue 36 and pin 38. Cylindrical extension 46 is made integrally with threaded element 42 in the preferred embodiment. However, it can be made separately from threaded element 42, as shown in FIG. 4, such that threaded element 42 can be turned independently of cylindrical extension 46.

FIG. 3 shows a string clamping plate 26 which includes a hole 27 whose size is sufficient to accommodate pin 38 (FIG. 5) during an extraction process. It also accommodates spigot 29 on clamping screw during normal use.

Operation of the Preferred Embodiment—FIG. 5

First, unscrew threaded element 42 (FIG. 2) until tongue 36 is fully extended on the extractor, then unscrew clamping screw 28 (FIG. 5) on the tremolo sufficiently to free clamping screw spigot 29 from hole 27 on plate 26. Extractor 30 is then placed down against saddle 22 (FIG. 5), with tongue 36 inserted into central opening slot 25, until it contacts brass seat 35 under clamping plate 26. Pin 38 is then engaged into hole 27 ready for extracting the clamping plate. Cylindrical extension 46 should rest against surface 23 of saddle 22. When wingnut and threaded element 42 are screwed downward causing extension 46 to bear hard against surface 23, tongue 36 will move upward, pulling string clamping plate 26 upward with it, into cavity 48 of cylindrical extension 46, (FIG. 5). Cylindrical extension is sized to accommodate both the tongue and the clamping plate, thus removing the plate and capturing it within the walls of the cylindrical extension.

Figures 6, 7, 8:
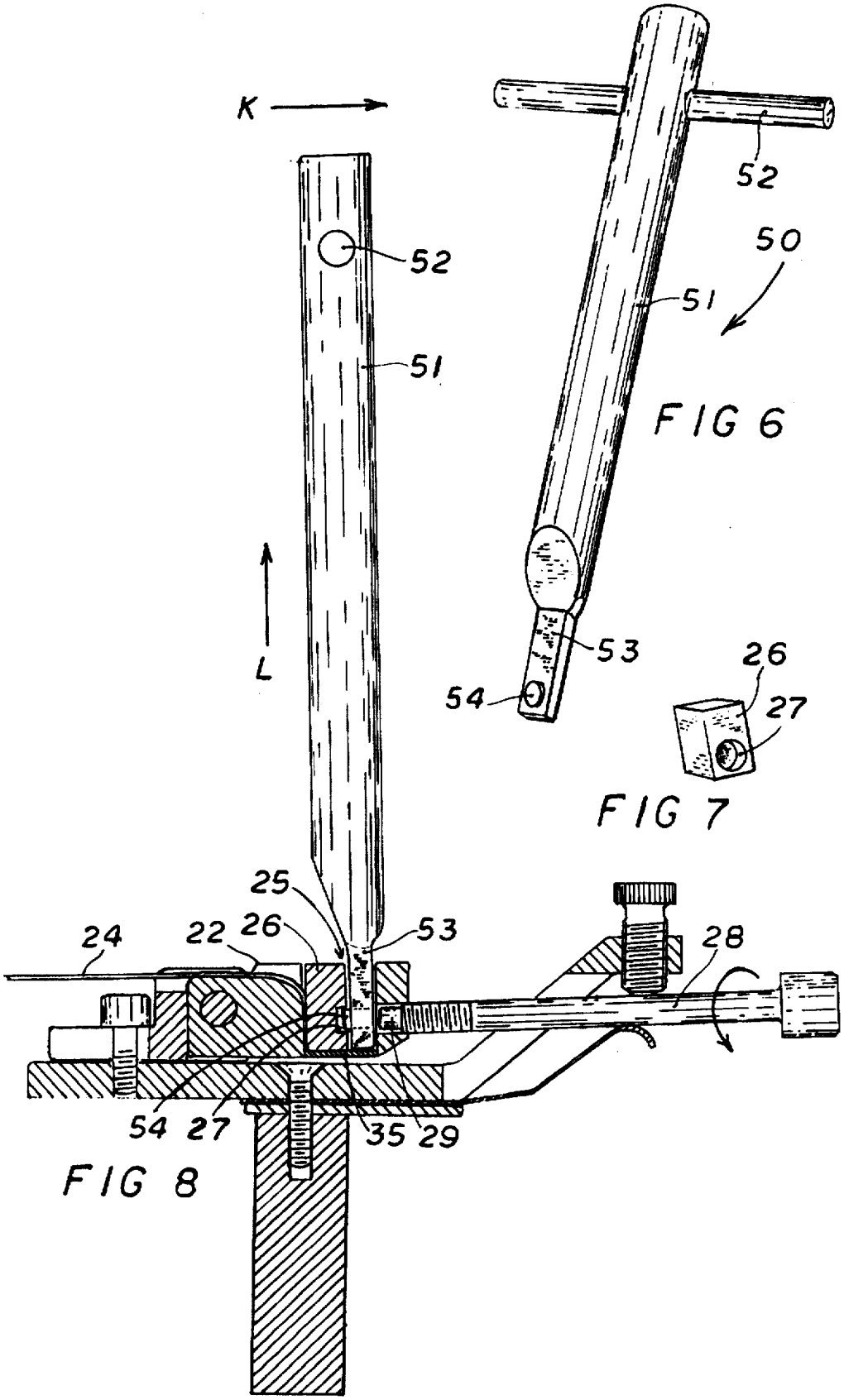
FIG. 6 is a perspective view of a second embodiment of the invention.
FIG. 7 is a perspective view of a string clamping plate.
FIG. 8 is a sectional view of a tremolo taken along the line of 8—8 of FIG. 1, with an extractor of the second embodiment shown in perspective view.

Second Embodiment—FIGS. 6–8

FIG. 6 shows a second embodiment extractor 50 comprising a handle stem, 51, a handle 52, at its first end, and a tongue 53 and pin 54 at its second end.

FIG. 7 shows a clamping-plate 26, with a hole 27 at its base end.

Operation of Second Embodiment—FIG. 8

FIG. 8 shows a sectional view of a Floyd Rose tremolo with extractor tongue 53, and pin 54 inserted behind plate 26 in central opening slot 25. To remove plate 26, the user pulls upward on stem 51, in the direction of arrow "L" while keeping a slight pressure on the top of handle stem 51 in the direction of arrow "K", which will have a levering action on tongue 53 and keep pin 54 engaged in hole 27 until plate 26 is extracted from central opening slot 25.

If a string clamping plate is not cracked, and is free to move within the central opening slot, it is necessary only to loosen clamping screw 28, pull the string out and replace it with a new one. However, if part of the string is broken off and remains in the opening slot, it is then necessary to remove the plate to get at the broken string's end. When strings need to be replaced, most users prefer to remove the clamping plate for thorough cleaning and inspection before discarding or replacing it.

Preferred Extractor Dimensions—FIGS. 3–8

Handle stem 32, diameter shown at 60 (FIG. 2), 6.35 mm. (0.25").

Tongue 36, length shown at 61 (FIG. 2), 10 mm. (0.39")

Tongue 36, width shown at 62 (FIG. 2), 3.81 mm. (0.050")

Pin 38, width shown at 63 (FIG. 2), 1.754 mm. (0.062")

Pin 38, depth shown at 64 (FIG. 2), 2.235 mm. (088")

Tongue 36, thickness shown at 65 (FIG. 4), 1.5675 mm. (0.0625")

Cylindrical extension 46, shown at OD. 66 (FIG. 4), 12.9 mm. (0.476")

Cylindrical extension 46, shown at ID. 67 (FIG. 4), 9.5 mm. (0.375")

Pin 38, shown at projection 68 (FIG. 4), 1 mm. (0.039")

Other measurements are to scale.

Preferred Manufacturing Materials—FIGS. 2–8

The preferred material for the manufacture of the handle stem, including the tongue and integral pin is medium to high carbon steel, such as tool steel, which offers strength and good wearing quality. However, any other suitable material can be used which has similar qualities. Preferably the cylindrical extension is made of Teflon®, whose purpose is to prevent damage to the saddle's surface while under pressure from the wingnut and threaded element. Any other suitable material which offers similar qualities can be used to manufacture the cylindrical extension. The cylindrical extension, threaded element, and wingnut, can be made integrally, or they can be machined to fit together as a single part from different materials. The handle can be made from any suitable material.

SUMMARY, RAMIFICATIONS, AND SCOPE

Thus, the reader will see that I have provided an extractor for the easy removing of single string locking plates in Floyd Rose tremolos. In the past this has been a difficult problem, which has often resulted in repair people driving the plate out through the bottom of the saddle, removing the seat provided by the manufacturer for locating the plate in proper position in the central opening slot. Since a novice depends on the seat to hold the plate in position when it is inserted, restringing a guitar becomes such a complicated and frustrating problem that many musicians must depend on expensive professional services to perform what should be a simple task. Sometimes, also, a string will break during a performance, creating an emergency situation, since the string must be replaced before the show can go on. At such times, it may be inconvenient if not impossible for the musician to take the guitar to a repair shop, and expensive for him to keep a repairman or replacement instrument on the premises.

Also, I have provided a tool for the general maintenance of a guitar fitted with a Floyd Rose tremolo, and which can be used by guitar owners and musicians to maintain their instruments in good order.

While the above description contains many specificities, the reader should not construe these as limitations on the scope of the invention, but merely as exemplifications of preferred embodiments thereof. Those skilled in the art will envision that many other possible variations are within its scope. For example, skilled artisans will readily be able to change the force method used in the preferred embodiment, and replace the threaded element with a lever, or cam force method, or use a sliding weight on the handle stem to hammer the plate upward, or change the ID. of the cylindrical extension to a square, rectangular, or octagonal, or other shaped cavity or change the preferred dimensions of the extractor parts to being longer, shorter, thicker or thinner.

Accordingly, the reader is requested to determine the scope of the invention by the appended claims and their legal equivalents, and not by the examples which have been given.

I claim:

1. A tool for extracting a string clamping plate from a guitar tremolo, said tool comprising:

a handle stem having a first end and a second end, a handle suitable for grasping attached to said first end of said handle stem, a tongue extending from said second end of said handle stem, a pin extending perpendicularly from said tongue, a threaded section on said handle stem intermediate said first end and said second end, a cylindrical extension which fits over said handle stem, and a threaded element which screws onto said threaded section of said handle stem, whereby an extraction force is applied to said string clamping plate by said tool by rotating said threaded element with respect to said threaded section of said handle stem such that said threaded element bears against said cylindrical extension to move said cylindrical extension axially with respect to said handle stem.

2. The tool of claim 1 wherein said cylindrical extension is integrally attached to said threaded element.

3. The tool of claim 1 wherein said cylindrical extension is separate from said threaded element so that said threaded element can be rotated independently of said cylindrical extension.

4. The tool of claim 1 wherein said cylindrical extension has an internal diameter sufficient to simultaneously accommodate said tongue and said string clamping plate.

5. A tool for extracting a string clamping plate from a guitar tremolo of the type having at least one string clamping plate having at least one hole therein, said string clamping plate fitting into a slot in said guitar tremolo, said tool comprising:

a handle stem having a first end and a second end, a handle suitable for grasping attached to said first end of said handle stem, a tongue extending from said second end of said handle stem, said tongue being sized to fit into said slot alongside said string clamping plate, a pin extending perpendicularly from said tongue, said pin being sized to enter and engage said hole in said string clamping plate, a threaded section on said handle stem intermediate said first end and said second end, a cylindrical extension which fits over said handle stem, and a threaded element which screws onto said threaded section of said handle stem, whereby said tool is used to grasp said string clamping plate and extract said string clamping plate from said slot in said guitar tremolo, whereby an extraction force is applied to said string clamping plate by said tool by rotating said threaded element with respect to said threaded section of said handle stem so that said threaded element bears against said cylindrical extension to move said cylindrical extension axially with respect to said handle stem.

6. The tool of claim 5 wherein said cylindrical extension is integrally attached to said threaded element.

7. The tool of claim 5 wherein cylindrical extension is separate from said threaded element so that said threaded element can be rotated independently of said cylindrical extension.

8. The tool of claim 5 wherein said cylindrical extension has an internal diameter sufficient to simultaneously accommodate said tongue and said string clamping plate.

9. In combination:

a guitar tremolo of the type having at least one string clamping plate slidingly disposed within a slot in said tremolo, said slot having a length, a width and a depth, said string clamping plate having a length, a width and a depth, the length and width of said string clamping plate being less than the length and width of said slot respectively, said string clamping plate having at least one transverse hole therein, said transverse hole having an internal diameter, and a tool for extracting said string clamping plate from said slot in said guitar tremolo, said tool comprising:

a handle stem having a first end and a second end, a handle suitable for grasping attached to said first end of said handle stem, a tongue extending from said second end of said handle stem, said tongue having a width which is less than the width of said slot and a thickness which is less than the difference between the length of said slot and the length of said string clamping plate, and a pin extending perpendicularly from said tongue, said pin having an external diameter which is less than said internal diameter of said transverse hole, whereby said string clamping plate is grasped for application of an extraction force by said tool by inserting said tongue into said slot beside said string clamping plate and inserting said pin into said transverse hole.

10. The combination of claim 9, wherein said tool further comprises:

an externally threaded section on said handle stem intermediate said handle on said first end and said tongue extending from said second end, a cylindrical extension which fits over said second end of said handle stem and said tongue extending from said second end, and an internally threaded element which screws onto said externally threaded section of said handle stem, whereby an extraction force is applied to said string clamping plate by said tool by inserting said tongue into said slot beside said string clamping plate, then inserting said pin into said transverse hole and rotating said internally threaded element with respect to said externally threaded section of said handle stem such that said threaded element bears against said cylindrical extension to move said cylindrical extension axially with respect to said handle stem.

11. The combination of claim 10 wherein said cylindrical extension is integrally attached to said internally threaded element.

12. The combination of claim 10 wherein said cylindrical extension is separate from said threaded element so that said threaded element can be rotated independently of said cylindrical extension.

13. The combination of claim 10 wherein said cylindrical extension has an internal diameter sufficient to simultaneously accommodate said tongue and said string clamping plate as said string clamping plate is extracted from said slot in said tremolo.

* * * * *